US006343629B1

(12) United States Patent
Wessman et al.

(10) Patent No.: US 6,343,629 B1
(45) Date of Patent: Feb. 5, 2002

(54) COUPLING DEVICE FOR COUPLING A VIAL CONNECTOR TO A DRUG VIAL

(75) Inventors: Göran Wessman; Kjell Andreasson, both of Göteborg (SE); Ingvar Andersson, Örebro (SE)

(73) Assignee: Carmel Pharma AB (SE)

( * ) Notice: Subject to any disclaimer, the term of this patent is extended or adjusted under 35 U.S.C. 154(b) by 0 days.

(21) Appl. No.: 09/586,390

(22) Filed: Jun. 2, 2000

(51) Int. Cl.[7] ..... B67C 3/00

(52) U.S. Cl. ..... 141/383; 141/329; 141/368

(58) Field of Search ..... 141/383, 329, 141/330, 348, 349, 368, 386; 53/287, 329, 331.5, 485

(56) References Cited

U.S. PATENT DOCUMENTS

| | | | |
|---|---|---|---|
| 1,908,216 | A | 5/1933 | Bergman |
| 1,968,264 | A | 7/1934 | Rice |
| 2,152,534 | A | 3/1939 | Carvalho et al. |
| 5,766,147 | A | 6/1998 | Sancoff et al. |

FOREIGN PATENT DOCUMENTS

| | | |
|---|---|---|
| EP | 0829250 | 3/1998 |
| FR | 2714824 | 1/1994 |
| WO | 9832411 | 7/1998 |

*Primary Examiner*—Gregory L. Huson
*Assistant Examiner*—Peter deVore
(74) *Attorney, Agent, or Firm*—Kilpatrick Stockton LLP

(57) ABSTRACT

A coupling device for coupling a vial connector to a drug vial, comprising actuating means (112'), for bringing the drug vial and/or the vial connector (105') into a third position in which a cannula (108') penetrates a seal (104') of the drug vial in a direction along an axis (A) substantially perpendicular ($\alpha \approx 90°$) to a main plane (P) of the seal (104'), and guiding means (113) controlling the direction. The actuating means (112') are designed for applying a force on the drug vial and/or the vial connector (105') enabling the locking means (106', 107') to become permanently locked around the neck (102'). The first positioning means (110') are adjustable for holding drug vials (101') of several different dimensions and/or the second positioning means (111') are adjustable for holding vial connectors (105') of several different dimensions. The coupling device allows the positioning means to release the vial and the vial connector, and can be utilised in connection with aseptic preparation and handling of drugs.

26 Claims, 7 Drawing Sheets

COUPLING DEVICE FOR COUPLING A VIAL CONNECTOR TO A DRUG VIAL

TECHNICAL FIELD

The present invention relates to a coupling device for coupling a vial connector to a drug vial. The invention can be implemented for aseptic preparation and handling of drugs involving a special vial connector having a cannula which is utilised for puncturing the seal of a drug vial or another drug bottle.

BACKGROUND OF THE INVENTION

When preparing drugs, intended for e.g. injection or infusion, demands are made on aseptic conditions. In order to achieve such conditions when preparing drugs, for example in hospitals and pharmacies, special safety boxes or cabinets in a clean room environment normally are utilised.

Recently, a serious problem in connection with drug preparation and other similar handling has been observed. It has been found that medical and pharmacological staff can be exposed to drugs or solvents in the ambient air while performing drug preparation. This problem is particularly serious when the preparation of e.g. cytotoxic drugs is concerned. Cytotoxic drugs have been reported to constitute a working environment problem when they escape into the environment. Antiviral drugs, antibiotics and radiopharmaceuticals are other drugs which can create working environment problems.

Therefore, it has been proposed that aseptic preparation and handling of drugs should be accomplished by means of special assemblies which are sealed against the ambient air before and during administration to a patient.

Accordingly, U.S. Pat. No. 5,766,147 discloses a device which provides for direct incorporation of a substance from a separate container, such as a drug vial, into the contents of a liquid delivery device, which has a connecter to provide communication between the device and the container, and means for closing the connection prior to dispensing the contents of the device. Furthermore, U.S. Pat. No. 5,766,147 discloses a method for permitting a substance in a container to be transferred to a liquid delivery device, and the contents of the device to be administrated to a patient.

Furthermore, WO 98/32411 discloses a luer connector comprising a luer connectable to a syringe and which extends to a sharpened end capable of being driven through a puncturable vial closure to thereby puncture the closure, a luer support which is mountable on a vial and which initially supports the luer in a first position in which the sharpened end of the conduit is pointed towards the closure. The luer connector further comprises a luer driver such that movement of the driver relative to the support causes the luer to be driven so that the sharpened end punctures the closure and enters the vial. The luer connector facilitates connection of a hypodermic syringe to the vial.

The patent publication FR 2 714 824 discloses a vial device comprising an external cover exhibiting a first, open end and a second, closed end provided with a passage for a liquid. The cover comprises perforating means in which the perforating end projects through the passage into the cover. The perforating means exhibits an internal channel which extends the passage. Thereby, a vial exhibits a body having a a first end provided with puncturable membrane and a second end sealed by a piston slidingly mounted within the body of the vial. When in a storage position, the vial is coupled to the cover and is arranged to be pressed into the cover in such a way that the perforating means punctures the deformable membrane, with sealing means between the cover and the body of the vial.

Many drugs are provided in a dry form in order to achieve a longer shelf life, e.g. so-called lyophilized drugs. Such drugs have to be prepared by means of adding a suitable solvent before being administrated to a patient. This is usually accomplished by means of a special connector assembly or the like for enabling attachment of the vial to a source of solvent to reconstitute the dry drug.

Accordingly, EP 0 829 250 A2 discloses a connector assembly for efficient flow of liquid into and/or out of a vial, such as a vial containing a lyophilized drug. The connector assembly features a collar which is mountable to the rim of the vial in a locked position and thereafter removable by an end-user when disposal of the device is desired.

Thus, aseptic preparation and handling of drugs often involve that a special connector having a cannula is utilized for puncturing the seal or closure of a drug vial or drug bottle. The previously known methods for coupling such connectors to a vial and puncturing the seal of the vial are associated with certain problems.

For instance, it has been found that the cannula of the vial connector often may puncture the vial seal in an undesirable way, e.g. so that the cannula creates a larger perforation in the vial seal than necessary, and thereby increases the risk that cytotoxic drugs or the like escape into the working environment.

In cases where the previously known vial connectors are pressed down manually around the neck of a drug vial, it can be difficult to obtain a sufficient force in order to obtain a secure locking of the connector around the neck of the vial.

Furthermore, the previously known assemblies for coupling a connector to the neck of a vial or bottle can only accommodate drug vials or bottles of one single predetermined size. In view of the above described deficiencies associated with previously known assemblies and methods for coupling a connector to the neck of a vial or bottle, the present invention has been developed. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventional assemblies and methods for coupling a connector to the neck of a vial or bottle and incorporates several additionally beneficial features.

Accordingly, a first object of the present invention is to provide a coupling device for coupling a vial connector to a drug vial which eliminates the above-mentioned problems associated with known devices and methods. Furthermore, arrangements configured according to the present invention ensure that vial connectors of different sizes can be coupled to drug vials or bottles of different sizes in a way preventing the cannula of the vial connector from creating a larger hole than necessary in the seal of the drug vial, while ensuring that the vial connector is pressed down over the neck of the vial with a force sufficient for achieving a permanent coupling of the vial connector to the drug vial.

This first object of the present invention is achieved by means of the coupling device comprising first positioning means for holding the drug vial in a first position, and further comprising second positioning means for holding the vial connector in a second position. The coupling device further comprises actuating means for bringing the drug vial and/or the vial connector into a third position in which the cannula penetrates the seal in a direction along an axis substantially perpendicular to a main plane of the seal. According to the invention, the coupling device comprises guiding means controlling the direction, wherein the actuating means are designed for applying a force in the above-mentioned direction on the drug vial and/or the vial connector enabling the locking means to become permanently locked around the neck when reaching the third position. Thereby, the first positioning means are adjustable for holding drug vials of several different dimensions and/or the second positioning means are adjustable for holding vial connectors of several different dimensions. Furthermore, the coupling device is designed for allowing the first and second positioning means to release the vial and the vial connector after having reached the third position.

Further objects of the present invention will become evident from the following description, while the features enabling the further objects to be reached are defined in the dependent claims.

The beneficial effects described above apply generally to each of the exemplary devices and methods disclosed herein as they relate to coupling a connector to the neck of a vial or bottle. The specific structures and steps through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

In the following, a preferred embodiment and a number of alternative embodiments of a coupling device according to the invention, intended for coupling a vial connector to a drug vial, will be described with reference to the attached FIGS. 1–7.

Figure 1:
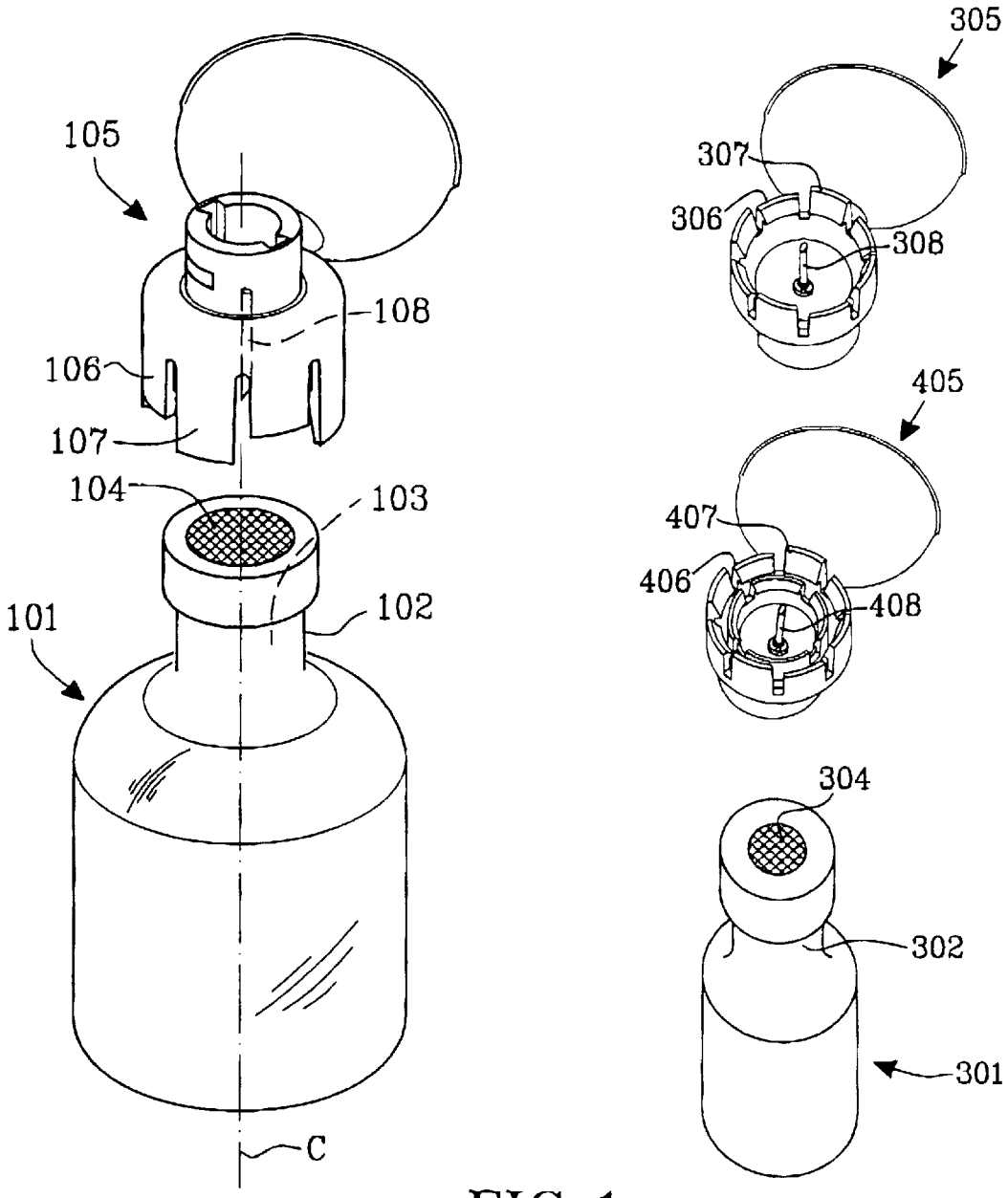
FIG. 1 shows a perspective view of drug vials 101; 301 and vial connectors 105; 305, of two different sizes, wherein each vial connector 105; 305 is intended to be permanently coupled to its respective vial 101; 301 by means of the coupling device according to the invention.
Figure 2:
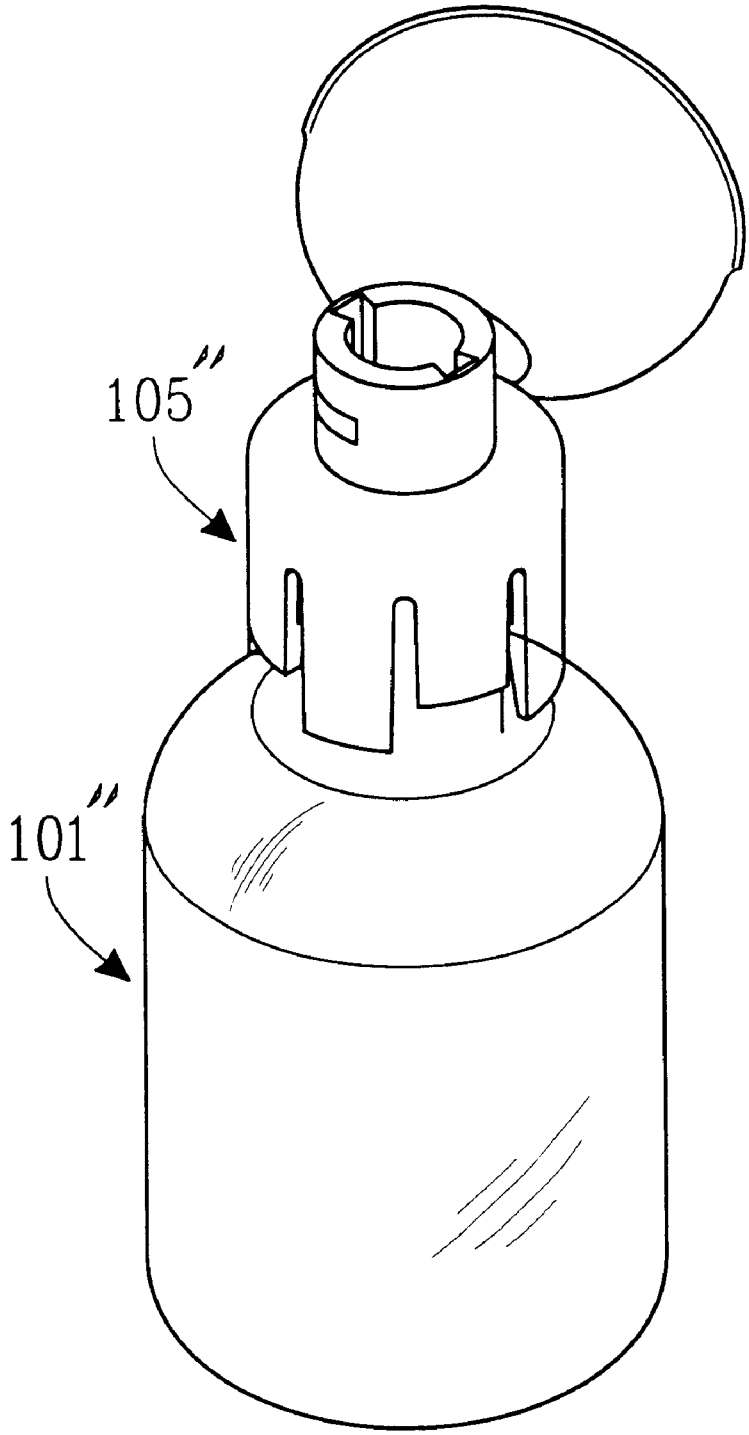
FIG. 2 shows one of the drug vials 101" and the vial connector 105" in FIG. 1 after being permanently coupled together by means of the device according to the invention.
Figure 3:
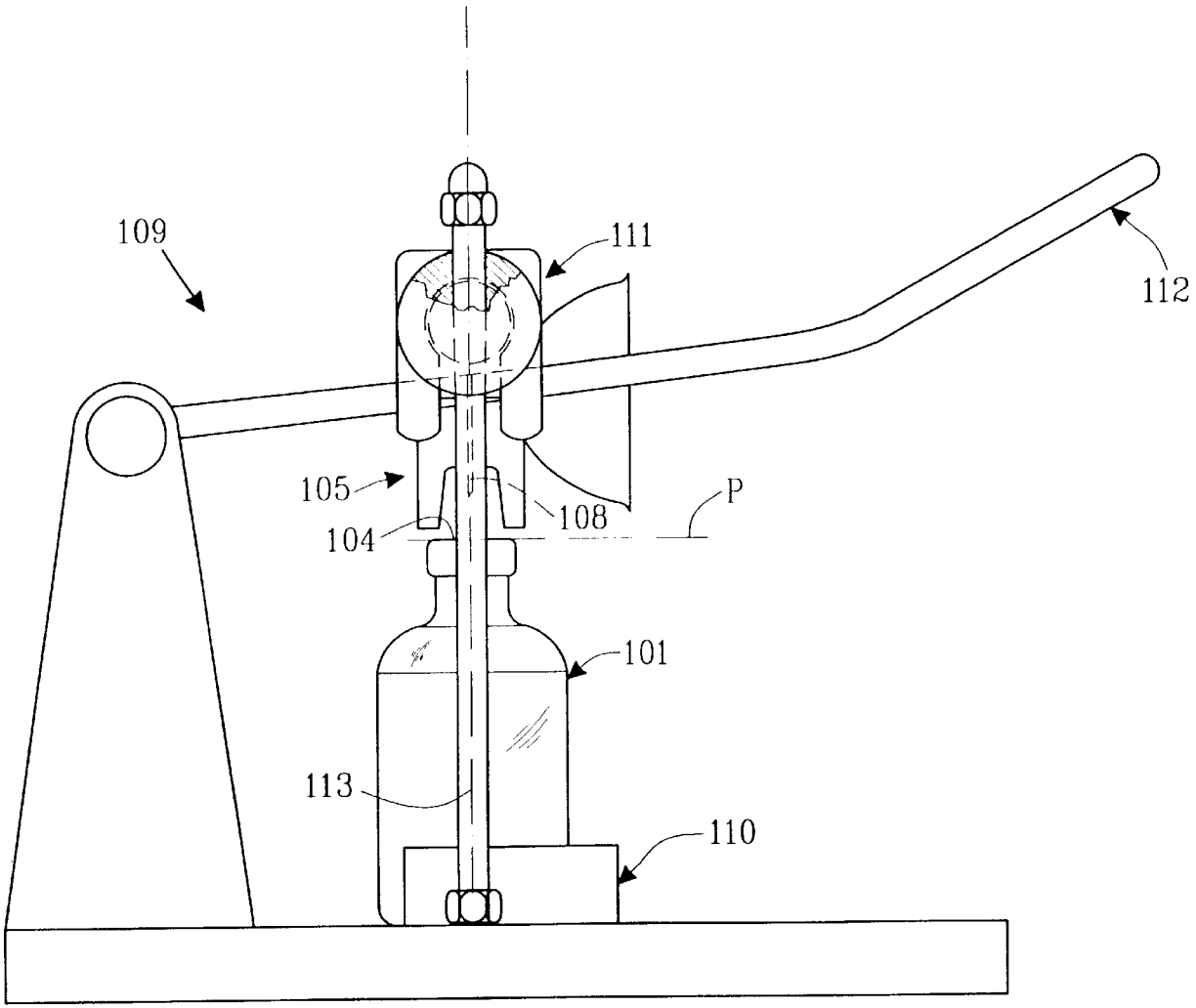
FIG. 3 shows a side view of a coupling device 109 according to a preferred embodiment of the invention with a drug vial 101 in a first position and a vial connector 105 in a second position.
Figure 4:
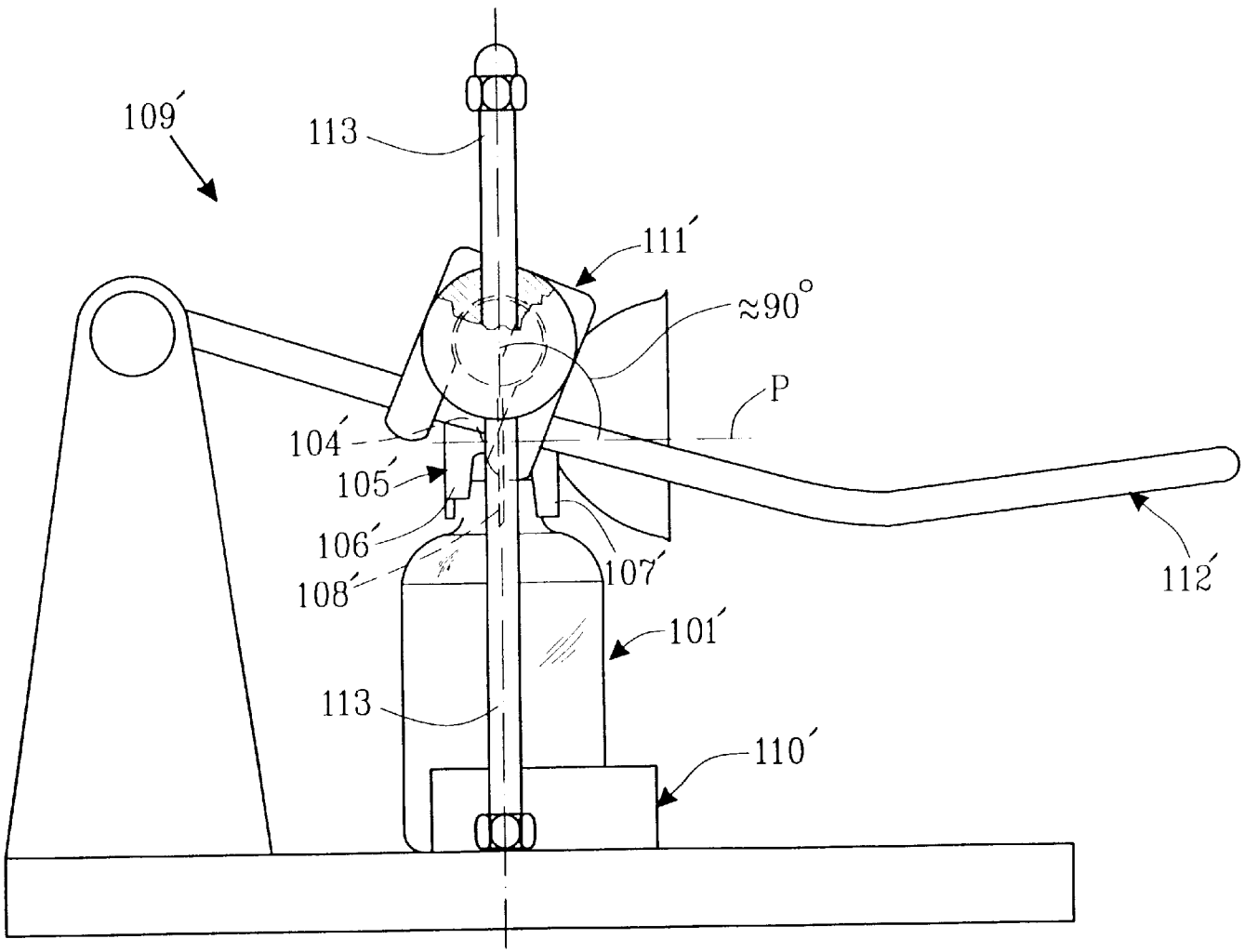
FIG. 4 shows a side view of the coupling device 109' in FIG. 1 when the vial connector 105' has been brought into a third position and the coupling has taken place.
Figure 5:
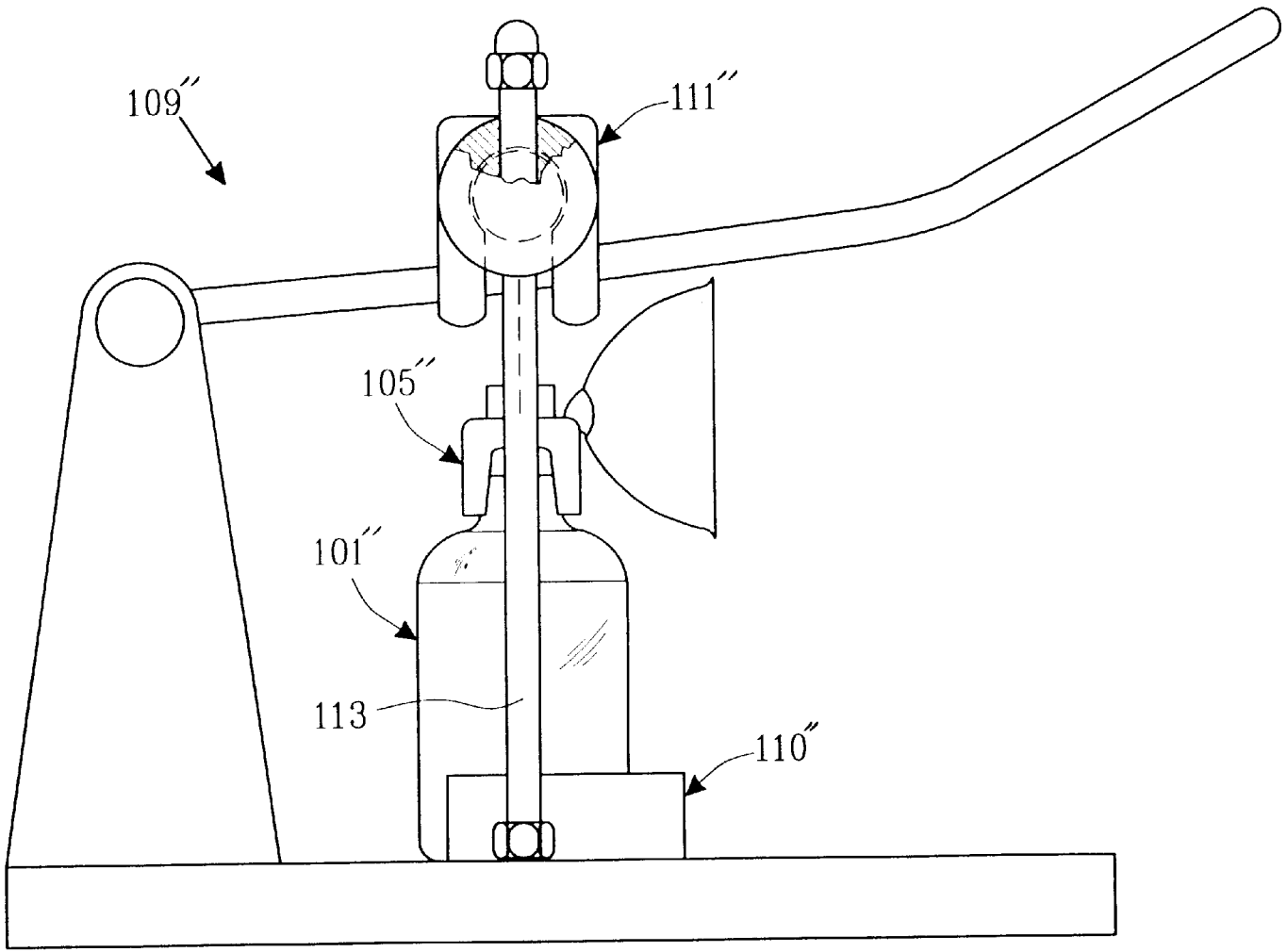
FIG. 5 shows a side view of the coupling device 109" in FIG. 1 in a state which allows first 110" and second 111" positioning means to release the vial 101" and the vial connector 105" permanently locked around the neck of the vial.
Figure 7:
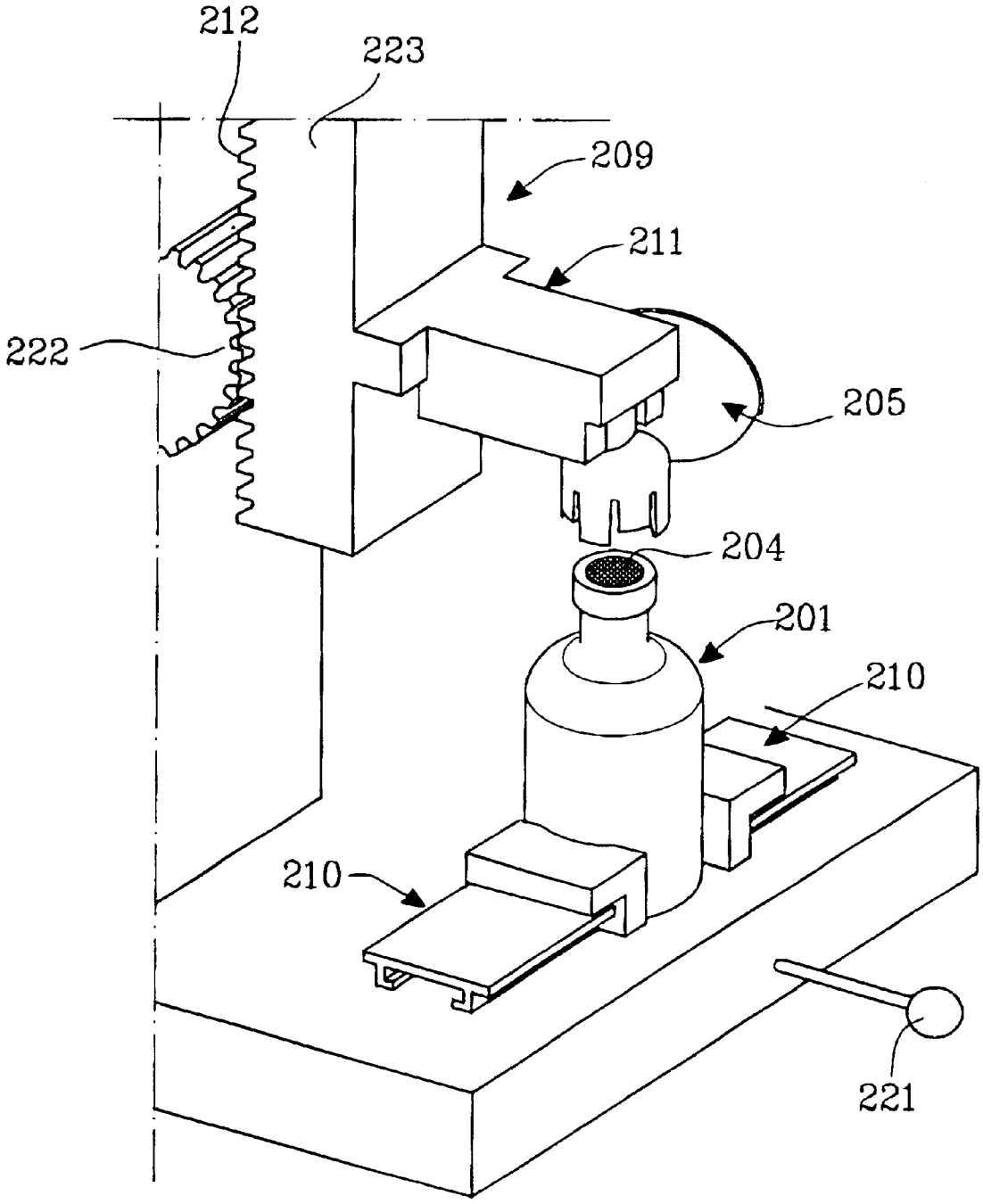
FIG. 7 shows a perspective view of a portion of a coupling device 201 according to an alternative embodiment of the invention.

The coupling device according to the invention is in tended to be used with drug vials 101 (or bottles) of a type comprising a neck 102 havingy an opening I103'covered by a seal 104. Such drug vials are well-known to the skilled person and will not be discussed in greater detail herein. FIG. 1 shows drug vials 101 and 301 which are of two different sizes, whereas FIG. 7 shows a drug vial 201 of a third size.

Furthermore, the coupling device according to the invention is intended to be used with vial connectors 105 of a type having locking means 106, 107 for grasping the neck 102 and at least one cannula 108 for penetrating the seal 104 of the drug vial. In connection with this, it can be mentioned that the drug vials for use with devices constructed according to the invention can have seals 104; 204; 304 with different outer diameters, e.g. 14 or 21 mm. Vial connectors of the type in question are well-known to the skilled person and will not be described in greater detail herein. However, vial connectors 105; 205; 305 of the type shown in the drawings which include pressure compensating means in the form of an expandable bladder or the like are preferred for use in the coupling device according to the invention.

As illustrated by the vial connector 305 in FIG. 1, vial connectors of a type having short locking means 306 alternating with longer locking means 307 are particularly preferred for use with the coupling device according to the invention. Such vial connectors makes the coupling easier, since the longer locking means 307, after having been brought down around the vial neck 302, will act as guiding means until also the shorter locking means 306 have been brought down around the vial neck and all the locking means 306, 307 have "snapped" down around the vial neck 302 into their final positions.

Furthermore, as illustrated by the vial connector 405 in FIG. 1, a special adapter with locking means adapted for fitting around the vial neck dimension in question can be pressed down around the cannula 408, so that the adapter is encircled by the original locking means 406,407 of the vial connector 405. Accordingly, the vial connector 405 can be obtained by means of applying a special adapter onto the vial connector 305. In this way, by means of providing appropriate adapters, the same vial connector can be utilized for coupling to vial necks of different dimensions. Also, the locking means of the adapter can have short locking means alternating with longer locking means.

According to the invention, the coupling device 109 comprises first positioning means 110 for holding the drug vial 101 in a first position, and second positioning means 111 for holding the vial connector 105 in a second position.

Furthermore, according to the invention, the coupling device comprises actuating means 112 for bringing the drug vial and/or the vial connector 105' into a third position in which the cannula 108' penetrates the seal 104' in a direction along an axis A substantially perpendicular $\alpha \approx 90°$ to a main plane P of the seal 104'.

In the preferred embodiment, the first positioning means 110 comprise at least two vial engagement means 114, 115 (FIG. 6) designed for aligning a centerline C of the drug vial with the axis A. As will become evident to the skilled person, many different mechanical designs are conceivable for the first positioning means, e.g. a mechanical design known per se in which the two vial engagement means 114, 115 are connected by a spring or another elastic member.

In the preferred embodiment, the second positioning means 111 comprise snap-in means 116 designed for aligning the cannula 108 with the axis A. As will become evident to the skilled person, a number of different mechanical designs are conceivable also for the second positioning means, both mechanical designs relying on a spring or an elastic member and/or designs relying on friction between a convenient portion of the vial connector and a portion of the second positioning means.

According to the invention, the coupling device comprises guiding means 113 which control the direction. Of advancement in the preferred embodiment, the guiding means 113 comprise at least one elongate member 119, 120 which is/are rigidly attached to the support 118 in parallel with the axis A, and which elongate member(s) 119, 120 is/are designed for sliding contact with the actuating means 112. However, within the scope of the invention, also other technical designs of the guiding means are conceivable.

According to the invention (FIG. 4), the actuating means 112' are designed for applying a force in the above-mentioned direction on the drug vial and/or the vial connector 105' enabling the locking means 106', 107' (of the vial connector) to become permanently locked around the neck 102' (of the drug vial) when reaching the third position. Accordingly, it is conceivable with embodiments of the coupling device which achieve the coupling by means of displacing a vial connector into contact with an immovable drug vial. by means of displacing a drug vial into contact with an immovable vial connector, or by means of displacing both vial connector and drug vial towards each other until they contact each other.

In the preferred embodiment of the invention, the actuating means 112' are designed for applying a force in the above-mentioned direction on the drug vial and/or the vial connector 105' which is larger than 100 N, and preferably between 147 and 196 N.

By means of using conventional laboratory equipment for force measurements when coupling different vial connectors to different drug vials, the above-mentioned force levels were established as particularly advantageous because they enable coupling of vial connectors and drug vials which are able to provide a very strong permanent coupling, but without requiring an extraordinary physical strength of the person operating the device. However, within the scope of the invention, it is also conceivable with less advantageous embodiments where the actuating means are designed for applying a smaller or larger force than 100 N.

In the preferred embodiment (FIG. 6), the actuating means 112 comprise a handle 117 which is pivotally attached to a support 118. However, it is also conceivable with advantageous embodiments of the coupling device according to the invention in which the actuating means 212 comprise a gear wheel 222 and/or a gear rack 223, as shown in FIG. 7, or embodiments in which the actuating means comprise an electric motor, a hydraulic system, or a pneumatic system.

According to the invention, the first positioning means 110 are adjustable for holding drug vials 101; 201; 301 of several different dimensions and/or the second positioning means 111 are adjustable for holding vial connectors 105; 205; 305 of several different dimensions. This offers great advantages, since one single coupling device according to the invention can fulfil the entire need for a reliable and safe coupling assembly. As will become evident to the skilled person, many different mechanical designs are conceivable for the adjustable first and/or second positioning means.

Furthermore, according to the invention (FIG. 5), the coupling device 109" is designed for allowing the first 110" and second 111" positioning means to release the vial 101" and the vial connector 105" after having reached the third position. In the preferred embodiment, the coupling device 109" is designed for allowing an operator to release the vial 101" and the vial connector 105' which is now permanently locked around the neck from the first 110" and second 111" positioning means by means of hand power, after having reached the third position. As has become evident from the foregoing, this can be accomplished e.g. in the way shown in FIGS. 6 and 7, in which the first positioning means 110 comprise recessed vial engagement means 114, 115, which preferably are spring-loaded, and the second positioning means 111 comprise flexible snap-in means 116.

In an alternative embodiment, illustrated in FIG. 7, the coupling device 209 comprises a lever 221 for inducing engagement or release of the vial 201 and/or the vial connector 205 to/from the first 210 and/or the second positioning means.

Figure 6:
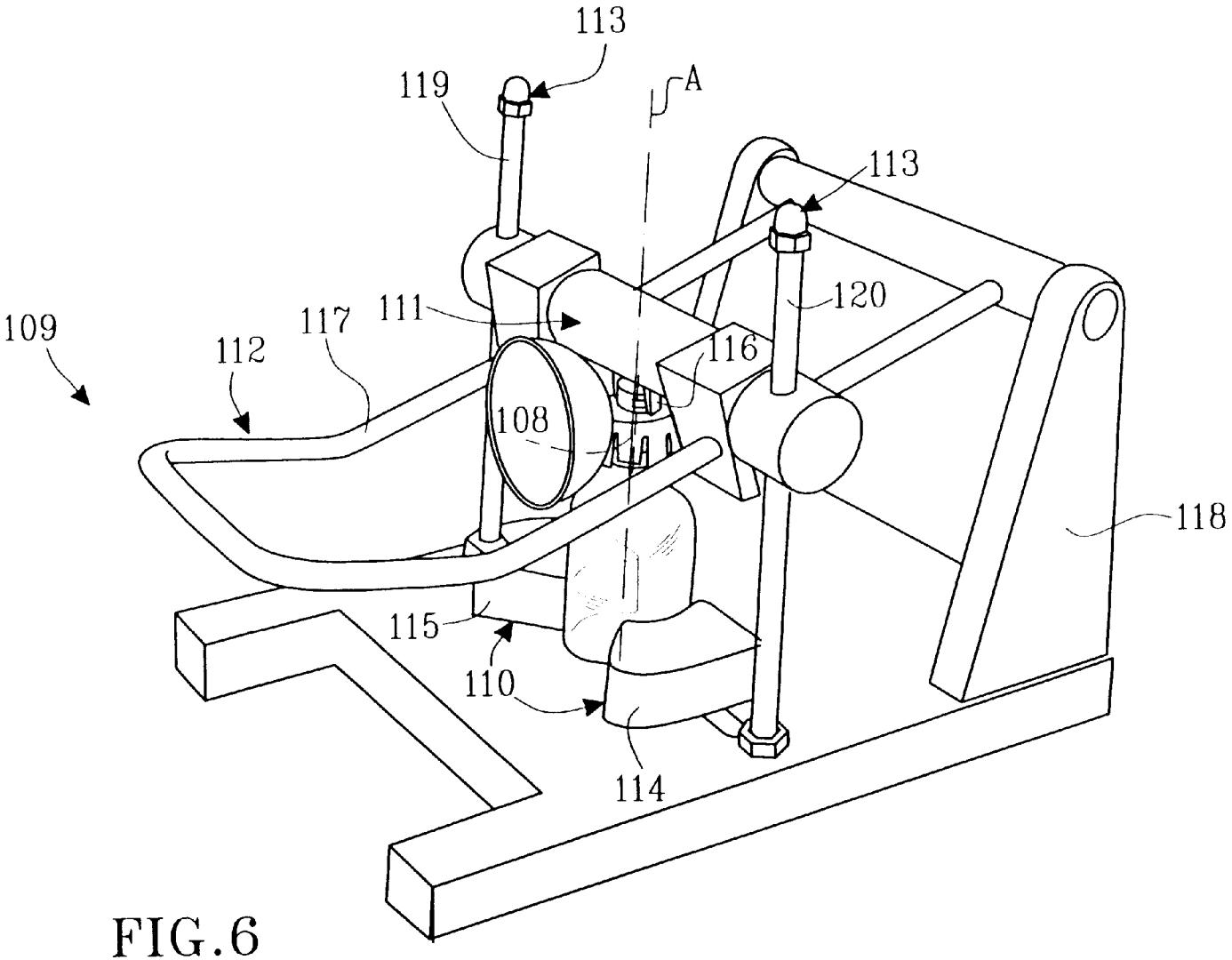
FIG. 6 shows a perspective view of the coupling device in FIG. 1, in a state when the third position has almost been reached.

Alternative language may be utilized to describe the same structures and methods disclosed hereinabove, and for which like reference numerals are used for designating like structures and steps. With reference again to FIGS. 1, 3 and 6, an alternative description designates the invention as an arrangement 109 for coupling a connector 105 to a drug vial 101 having a neck 102 with an opening 103 covered by a seal 104. The connector 105 has a locking arrangement utilizing short locking members 106 and long locking members 107, each of which are adapted to grasp the neck 102 of a drug vial 101. The connector 105 also carries a cannula 108 that is adapted to penetrate the seal 104 positioned across the neck 102 of the drug vial 101. A vial positioning arrangement 110 is adapted to releasably hold the drug vial 101 stationary in a connector receiving position. A connector positioning arrangement 111 is adapted to initially hold the connector 105 in a pre-install position that is at a predetermined location relative to the neck 102 of a drug vial 101 held by the vial positioning arrangement 110. An actuator 112 is provided and adapted to bring the connector 105 into an installed position as shown in FIG. 6 upon the neck 102 of a drug vial 101 so that the cannula 108 penetrates the seal 104 positioned across the neck 102 of the drug vial 101 in a substantially perpendicular direction to a top surface (P) of the seal 104. A guide 113 is utilized that is adapted to establish the substantially perpendicular direction of penetration of the cannula 108 into the seal 104. The actuator 112 is further adapted to apply an installation force on the connector 105 toward the neck 102 of the drug vial 101 of sufficient magnitude to install the connector 105 upon the neck 102 and to activate the locking arrangement 106,107 causing the connector 105 to become permanently locked to the neck 102 of the drug vial 101 when the installed position is achieved.

The vial positioning arrangement 110 is adapted to be adjustable to accommodate holding drug vials 101 of different dimensions and the connector positioning arrangement 111 is adapted to be adjustable to accommodate holding connectors 105 of different dimensions.

The vial positioning arrangement 110 and the connector positioning arrangement 111 are adapted to release a drug vial 101 and the connector 105, respectively, after the installed position is achieved.

The actuator incorporates a handle 117 pivotally coupled to a support 118 for urging the connector 105 to the installed position. The actuator 112 is adapted to apply an installation force through the connector positioning arrangement 111 in a magnitude of at least 100 N, and preferably in a magnitude ranging between 147 and 196 N.

The vial positioning arrangement 110 utilizes at least two vial engaging members 114,115 adapted to align a centerline C of any drug vial 101 held therein with a centerline A of a connector 105 to be installed thereupon. In other words, the centerlines of the drug vial 101 and connector 105 should be oriented to be substantially coincident. This presumes also that in a preferred embodiment, a centerline of the cannula 108 will be substantially aligned with the centerline A of the connector 105 on which it is carried when properly installed thereupon.

The connector positioning arrangement 111 includes a receiver 116 configured for releasable engagement with the connector 105, the receiver 116 being arranged to align the cannula 108 about the centerline C of a drug vial 101 held in the vial positioning arrangement 110.

The guide includest least one elongate member 119,120 rigidly attached to the support 118 in parallel with the centerline of the connector A. The elongate member(s) 119,120 is/are adapted for sliding engagement with at least a portion of the actuator 112.

The connector positioning arrangement 111 is further adapted to allow an operator to release the connector 105 therefrom exclusively by hand power. Likewise, the vial positioning arrangement 110 is adapted to allow an operator to release a drug vial 101 therefrom exclusively by hand power. Each of these actions can be accomplished using the connector release lever(s) 221 (FIG. 7) for inducing release of the connector 105 from the connector positioning arrangement 111 and the drug vial 101 from the vial positioning arrangement 110.

It is further contemplated that the actuator 112 may utilize a gear wheel and a gear rack for moving the connector 105 into the installed position as depicted in FIG. 7. Still further, the actuator 112 may derive an actuating force from a drive source selected from one or more of the group including: an electric motor, a hydraulic system, and a pneumatic system.

The present invention should by no means be regarded as being limited to what has been disclosed in connection with the above-described embodiments, or to what is shown in the attached drawings, but the scope of the invention is defined by the following claims.

What is claimed and desired to be secured by Letters Patent is as follows:

1. A coupling device for coupling a vial connector to a drug vial, said drug vial (101) of a type comprising a neck (102) having an opening (103) covered by a seal (104), and said vial connector (105) of a type having locking means (106, 107) for grasping said neck (102) and at least one cannula (108) for penetrating said seal (104), said coupling device (109) comprising first positioning means (110) for holding said drug vial (101) in a first position, and further comprising second positioning means (111) for holding said vial connector (105) in a second position, and actuating means (112) for bringing said drug vial and/or said vial connector (105') into a third position in which said cannula (108') penetrates said seal (104') in a direction along an axis (A) substantially perpendicular ($\alpha \approx 90°$) to a main plane (P) of said seal (104'), and wherein said coupling device comprises guiding means (113) controlling said direction, and said actuating means (112') are designed for applying a force in said direction on said drug vial and/or said vial connector (105') enabling said locking means (106', 107') to become permanently locked around said neck (102') when reaching said third position, and said first positioning means (110) are adjustable for holding drug vials (101; 201; 301) of several different dimensions and/or said second positioning means (111) are adjustable for holding vial connectors (105; 205; 305) of several different dimensions, and said coupling device is designed for allowing said first (110") and second (111") positioning means to release said drug vial (101") and said vial connector (105") after having reached said third position.

2. A coupling device according to claim 1, wherein said actuating means (112') are designed for applying a force in said direction on said drug vial and/or said vial connector (105') which is larger than about 100 N.

3. A coupling device according to claim 2, wherein said actuating means (112') are designed for applying a force in said direction on said dmug vial and/or said vial connector (105') which is between about 147 and about 196 N.

4. A coupling device according to claim 1, wherein said first positioning means (110) comprise at least two vial engagement means (114, 115) designed for aligning a centre line (C) of said drug vial with said axis (A).

5. A coupling device according to claim 1, wherein said second positioning means (111) comprise snap-in means (116) designed for aligning said cannula (108) with said axis (A).

6. A coupling device according to claim 1, wherein said actuating means (112) comprise a handle (117) which is pivotally attached to a support (118).

7. A coupling device according to claim 1, wherein said guiding means (113) comprise at least one elongate member (119, 120) which is/are rigidly attached to said support (118) in parallel with said axis (A), and which elongate member(s) (119, 120) are designed for sliding contact with said actuating means (112).

8. A coupling device according to claim 1, wherein said coupling device (109") is designed for allowing an operator to release said drug vial (101") and said vial connector (105") from said first (110") and second (111") positioning means by means of hand power, after having reached said third position.

9. A coupling device according to claim 1, wherein said actuating means (212) comprise a gear wheel (222) and/or a gear rack (223).

10. A coupling device according to claim 1, wherein said actuating means comprise an electric motor, a hydraulic system, or a pneumatic system.

11. A coupling device according to claim 1, wherein said coupling device is adapted for permanently coupling a vial connector (305) having short locking means (306) alternating with longer locking means (307) to said drug vial (301).

12. An arrangement for coupling a connector to a drug vial, the drug vial having a neck with an opening covered by a seal, the connector having a locking arrangement adapted to grasp the neck of the drug vial and a cannula adapted to penetrate the seal positioned across the neck of the drug vial, said arrangement comprising:

a vial positioning arrangement adapted to releasably hold a drug vial stationary in a connector receiving positioning;

a connector positioning arrangement adapted to initially hold a connector in a pre-install position that is at a predetermined location relative to the neck of a drug vial held by said vial positioning arrangement;

an actuator adapted to bring said connector into an installed position upon the neck of a drug vial held by said vial positioning arrangement so that said cannula penetrates a seal positioned across the neck of the drug vial in a substantially perpendicular direction to a top surface of the seal; and a guide adapted to establish said substantially perpendicular direction of penetration of said cannula into a seal positioned across the neck of a drug vial held by said vial positioning arrangement and said actuator being further adapted to apply an installation force on said connector toward the neck of the drug vial and to activate said locking arrangement causing said connector to become permanently locked to the neck of the drug vial when said installed position is achieved.

13. The arrangement as recited in claim 12, wherein said vial positioning arrangement is adapted to be adjustable to accommodate holding drug vials of different dimensions and said connector positioning arrangement is adapted to be adjustable to accommodate holding connectors of different dimensions.

14. The arrangement as recited in claim 12, wherein said vial positioning arrangement and said connector positioning arrangement are adapted to release a drug vial and said connector, respectively, after said installed position is achieved.

15. The arrangement as recited in claim 12, wherein said actuator is adapted to apply said installation force in a magnitude of at least 100 N.

16. The arrangement as recited in claim 12, wherein said actuator is adapted to apply said installation force in a magnitude between 147 and 196 N.

17. The arrangement as recited in claim 12, wherein said vial positioning arrangement comprises at least two vial engaging members adapted to align a centerline of any drug vial held therein with a centerline of said connector.

18. The arrangement as recited in claim 12, wherein said connector positioning arrangement comprises a receiver configured for releasable engagement with said connector, said receiver arranged to align said cannula with a centerline of a drug vial held in said vial positioning arrangement.

19. The arrangement as recited in claim 12, wherein said actuator comprises a handle pivotally coupled to a support for urging said connector to said installed position.

20. The arrangement as recited in claim 19, wherein said guide comprises at least one elongate member rigidly attached to said support in parallel with said centerline of said connector, said elongate member adapted for sliding engagement with at least a portion of said actuator.

21. The arrangement as recited in claim 12, wherein said connector positioning arrangement is further adapted to allow an operator to release said connector therefrom exclusively by hand power.

22. The arrangement as recited in claim 12, wherein said vial positioning arrangement is further adapted to allow an operator to release a drug vial therefrom exclusively by hand power.

23. The arrangement as recited in claim 12, wherein said actuator comprises a gear wheel and a gear rack for moving said connector into said installed position.

24. The arrangement as recited in claim 12, wherein said actuator derives an actuating force from a drive source selected from the group comprising: an electric motor, a hydraulic system, and a pneumatic system.

25. The arrangement as recited in claim 12, further comprising:

said connector having short locking members alternating with long locking members for permanently coupling said connector to a drug vial.

26. An arrangement for coupling a connector to a drug vial having a neck with an opening covered by a seal, said arrangement comprising:

a vial positioning arrangement adapted to releasably hold a drug vial stationary in a connector receiving position;

a connector positioning arrangement adapted to initially hold a connector having a locking arrangement adapted to grasp a neck of a drug vial and a cannula adapted to penetrate a seal positioned across the neck of the drug vial in a pre-install position that is at a predetermined location relative to a location of a neck of a drug vial held by said vial positioning arrangement;

an actuator adapted to bring a connector into an installed position upon the neck of a drug vial held by said vial positioning arrangement so that a cannula of the connector penetrates a seal positioned across the neck of the drug vial in a substantially perpendicular direction to a top surface of the seal; and a guide adapted to establish said substantially perpendicular direction of penetration of the cannula into a seal positioned across the neck of a drug vial held by said vial positioning arrangement and said actuator being further adapted to apply an installation force on the connector toward the neck of the drug vial of sufficient magnitude to install the connector upon the neck of the drug vial and to activate a locking arrangement causing the connector to become permanently locked to the neck of the drug vial when said installed position is achieved.

* * * * *